US006735799B1

(12) United States Patent
Ellis et al.

(10) Patent No.: US 6,735,799 B1
(45) Date of Patent: May 18, 2004

(54) AIR SUPPLY APPARATUS FOR AN AIR MATTRESS

(75) Inventors: Craig D. Ellis, Charleston, SC (US); Kenith W. Chambers, Charleston, SC (US); Stephen E. Glover, Charleston, SC (US); Kerry J. Mensching, Mt. Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/509,452

(22) PCT Filed: Aug. 24, 1998

(86) PCT No.: PCT/US98/17493

§ 371 (c)(1),
(2), (4) Date: Mar. 21, 2000

(87) PCT Pub. No.: WO99/09864

PCT Pub. Date: Mar. 4, 1999

Related U.S. Application Data

(60) Provisional application No. 60/056,791, filed on Aug. 25, 1997.

(51) Int. Cl.[7] ..... A47C 27/08

(52) U.S. Cl. ..... 5/713; 5/658; 5/503.1

(58) Field of Search ..... 5/706, 710, 713, 5/658, 503.1; 340/575, 286.07

(56) References Cited

U.S. PATENT DOCUMENTS 4,312,352 A 1/1982 Meisch et al.
5,235,713 A 8/1993 Guthrie et al.
5,251,349 A * 10/1993 Thomas et al. ..... 5/713
5,267,364 A 12/1993 Volk
5,275,170 A * 1/1994 Lewis ..... 600/508
5,542,136 A 8/1996 Tappel
5,542,138 A * 8/1996 Williams et al. ..... 5/658
5,611,096 A 3/1997 Bartlett et al.
5,647,079 A 7/1997 Hakamiun et al.
5,664,270 A * 9/1997 Bell et al. ..... 5/600
5,729,853 A * 3/1998 Thompson ..... 5/713
5,815,864 A * 10/1998 Sloop ..... 5/706
5,975,081 A * 11/1999 Hood et al. ..... 128/845
5,983,429 A * 11/1999 Stacy et al. ..... 5/713
6,047,424 A * 4/2000 Osborne et al. ..... 5/713
6,339,410 B1 * 1/2002 Milner et al. ..... 345/1.1

FOREIGN PATENT DOCUMENTS

EP 0 649 645 A1 4/1995
WO WO 96/14785 5/1996

* cited by examiner

*Primary Examiner*—Anthony Knight
*Assistant Examiner*—James M. Hewitt
(74) *Attorney, Agent, or Firm*—Bose McKinney & Evans LLP

(57) ABSTRACT

A fluid supply apparatus (10) includes a housing (12), a fluid supply (114) located within the housing (12), a first hanger (60) coupled to the housing (12), and a second hanger (62) coupled to the housing (12). The first hanger (60) is configured to couple the housing (12) to a footboard (82) in a first orientation, and the second hanger (62) is configured to couple the housing (12) to the footboard (82) in a second orientation.

33 Claims, 7 Drawing Sheets

AIR SUPPLY APPARATUS FOR AN AIR MATTRESS

This application is a 371 of PCT/US98/17493 Aug. 24, 1998 which claims benefit of Ser. No. 60/056,791 Aug. 25, 1997.

BACKGROUND AND SUMMARY OF THE INVENTION

The present invention relates to an air supply apparatus. More particularly, the present invention relates to an improved air supply apparatus for controlling fluid flow to desired pieces of equipment, such as air mattress, therapy devices, or other components of a bed. Although the illustrated embodiments of the present invention disclose air blowers, it is understood that the present invention may also be useful with other types of fluid.

The air supply apparatus of the present invention is used to provide air or other type of fluid to an air mattress, to support a patient and to provide therapy to a patient. The air supply apparatus includes a housing which may be located on the floor adjacent a bed to control the air mattress or therapy device. In addition, the air supply apparatus may be coupled to a footboard of the bed in two different orientations, depending upon the configuration of the footboard and the desires of a caregiver.

The illustrated air supply apparatus includes a blower motor or compressor for supplying air to the mattress or therapy device. The air supply apparatus further includes a controller to provide rotation, percussion, and vibration therapies and to adjust pressure within air bladders in the mattress to enhance patient comfort. The illustrated controller includes a microprocessor located within the housing of the air supply unit. The processor stores data related to the therapies performed. This stored data can be downloaded through an output port located on the housing to a printer or computer. In other words, the air supply apparatus of the present invention includes a controller having a memory which stores the particular key strokes or therapies provided to a patient by the device. This historical information can then be printed or downloaded to a computer to analyze the data.

A control panel of the air supply apparatus is located on the housing. Various menus are displayed on the control panel. Features and therapies are controlled by a touch screen panel which provides increased flexibility of menu driven functions compared to membrane switches typically used on control panels of air supplies.

According to one aspect of the present invention, a fluid supply apparatus is provided for supplying fluid to a therapy device on a bed having a footboard. The apparatus includes a housing, a fluid supply located within the housing, a first hanger coupled to the housing, and a second hanger coupled to the housing. The first hanger is configured to couple the housing to the footboard in a first orientation, and the second hanger is configured to couple the housing to the footboard in a second orientation.

In the illustrated embodiment, the first and second hangers are pivotably coupled to a rear wall of the housing. The housing is formed to include first and second recessed portions adjacent the rear wall which are configured to receive the first and second hangers, respectively, in downwardly pivoted, storage positions. The first and second hangers are located inwardly from the rear wall of the housing when the first and second hangers are in the storage positions.

Also in the illustrated embodiment, the first hanger includes first and second spaced apart arms pivotably coupled to the housing. The first and second arms each include a hook portion configured to engage a top edge of the footboard to couple the housing to the footboard. A cross bar is coupled between the first and second arms of the first hanger. The cross bar is formed to include notched portions configured to engage the second hanger when the second hanger is in an outwardly pivoted position relative to the housing to hold the second hanger in a position to engage the footboard.

The second hanger includes first and second arms pivotably coupled to the housing and a U-shaped portion coupled between the first and second arms to define a hook configured to engage a top edge of the footboard. A protective coating is located over the U-shaped portion of the second hanger. The arms of the first hanger have a length greater than the arms of the second hanger. The arms of the first hanger are also spaced apart further than the arms of the second hanger.

According to another aspect of the present invention, a fluid supply apparatus is provided for controlling a therapy device. The apparatus includes a housing, a fluid supply located within the housing, a processor located within the housing, and a touch screen control panel coupled to the housing. The fluid supply is configured to be coupled to the therapy device. The processor is configured to the electrically coupled to the therapy device. The touch screen control panel is electrically coupled to the processor to receive operator inputs to control the therapy device.

In the illustrated embodiment, a memory located within the housing. The memory is coupled to the processor to store data related to inputs from the touch screen. A communication port is also coupled to the housing. The communication port is coupled to the processor and configured to be coupled to a computer to download information from the memory to the computer. The communication port is also configured to be coupled to a printer to print information stored in the memory. The computer can also upload information related to the therapy device to the processor. The computer transmits a menu for controlling the therapy device to the processor to be displayed on the touch screen control panel.

According to yet another aspect of the present invention, a fluid supply apparatus is provided for a therapy device. The apparatus includes a housing formed to include an elongated slot configured to define a storage receptacle, a fluid supply located within the housing, and a controller located within the housing. The fluid supply is configured to be coupled to the therapy device, and the controller is coupled to the fluid supply.

In the illustrated embodiment, a user manual configured to be inserted into the storage receptacle. The slot is formed adjacent a bottom end of the housing below the fluid supply. The housing includes a front case and a rear case configured to be coupled together to define the housing. A first portion of the slot is formed by the first case, and a second portion of the slot is formed by the second case.

According to still another aspect of the present invention, a fluid supply apparatus is provided for controlling a therapy device. The apparatus includes a housing, a fluid supply located within the housing, a processor located within the housing, the processor being configured to the electrically coupled to the therapy device, and a memory located within the housing. The fluid supply is configured to be coupled to the therapy device, and the memory is coupled to the processor to store data. The apparatus also includes a control panel coupled to the housing. The control panel is electrically coupled to the processor to receive operator inputs to control the therapy device. The apparatus further includes a communication port coupled to the housing. The communication port is coupled to the processor and configured to be coupled to a computer to download information from the memory to the computer. The computer is also configured upload information related to the therapy device to the processor.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
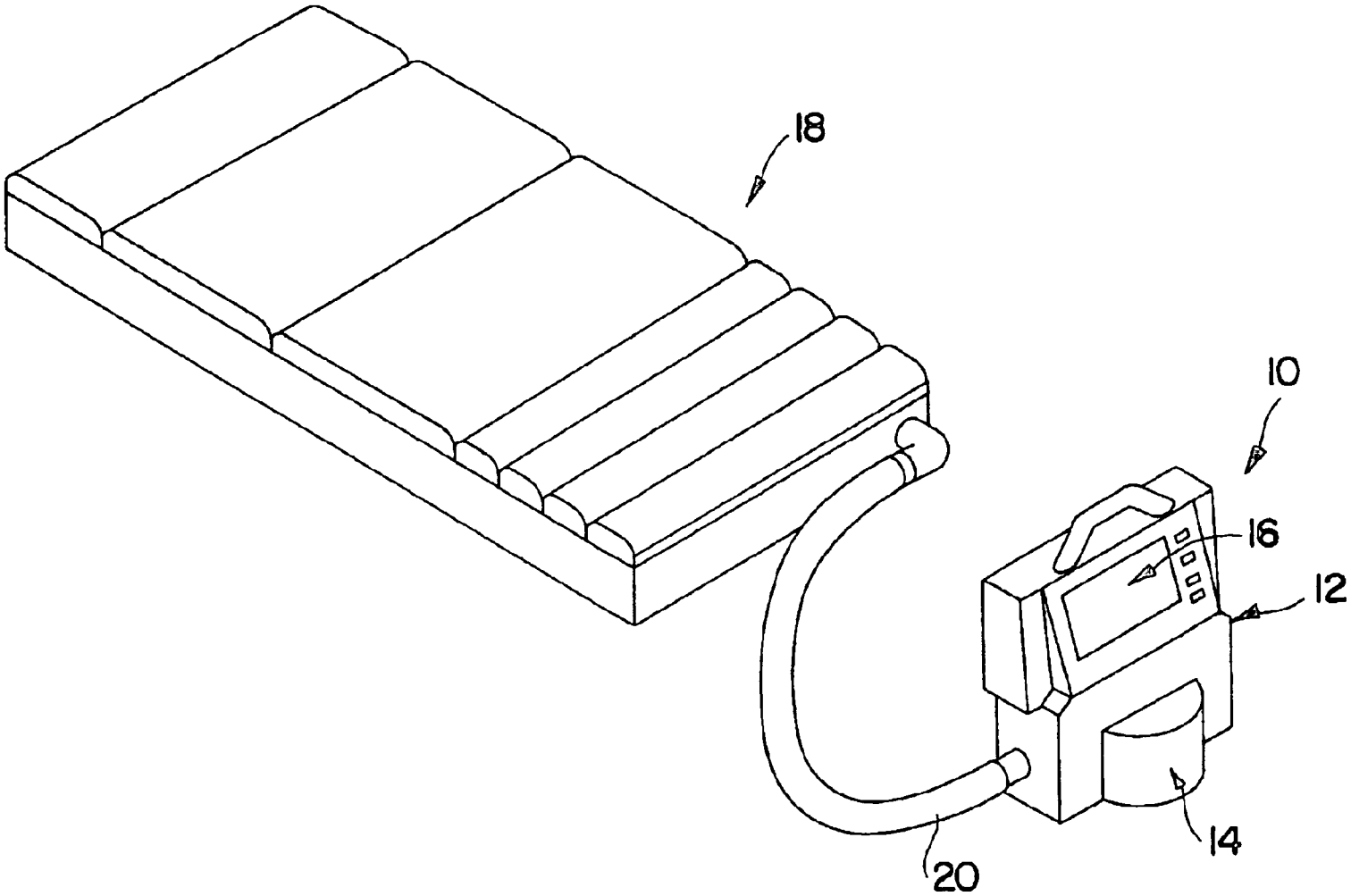
FIG. 1 is a perspective view illustrating an air supply apparatus of the present invention coupled to an air mattress by an air supply hose.

Referring now to the drawings, FIG. 1 illustrates an air supply apparatus 10 of the present invention including a housing 12 having a lower section 14 for receiving a blower motor and a touch screen control panel 16 for controlling operation of the air supply apparatus 10 and the therapies being performed on a therapy device such as an air mattress 18. Air supply apparatus 10 is coupled to the mattress 18 pneumatically by air supply tube 20. A controller of air supply apparatus 10 is also electrically coupled to the therapy device 18 by an electrical wire running through the air supply hose 20. Further details of the therapy mattress are disclosed in U.S. Pat. No. 6,021,533, owned by the assignee of the present application, the disclosure of which is incorporated herein by reference. In addition, valve assemblies for controlling therapies and air flow to various air bladders within the mattress 18 are disclosed in U.S. Pat. No. 6,202,672, owned by the assignee of the present application, the disclosure of which is incorporated herein by reference.

Figure 2:
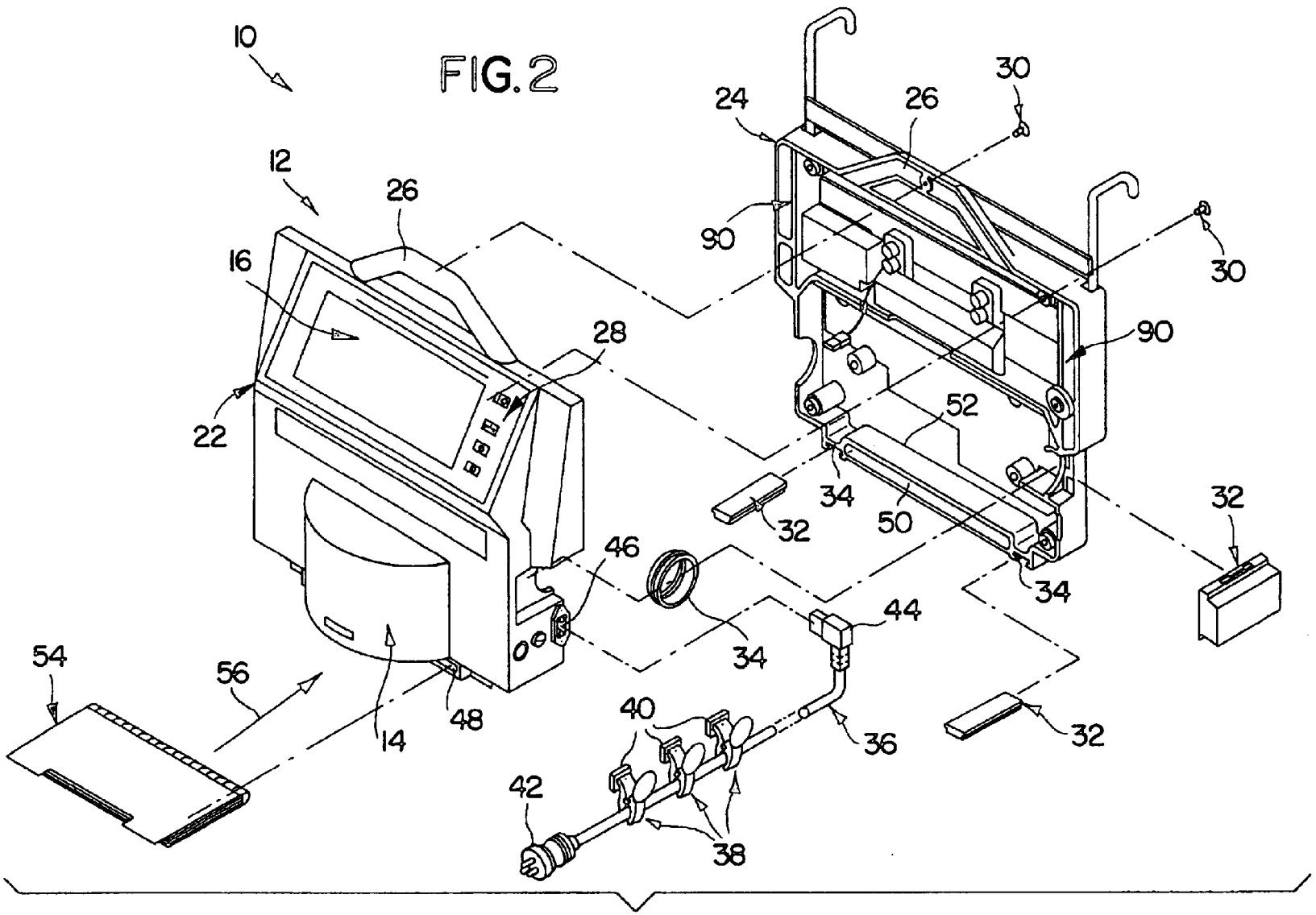
FIG. 2 is an exploded perspective view of the air supply apparatus of FIG. 1.

Details of the air therapy apparatus 10 are illustrated in FIGS. 2–8. Referring now to FIG. 2, the housing 12 includes a front case assembly 22 and a rear case assembly 24. Each of the front and rear case assemblies 22 and 24 is formed to include a portion of handle 26 for carrying the housing 12. Front case assembly 22 includes section 14 for receiving the blower motor or other fluid supply (not shown). Front case assembly 22 also includes a control panel 16 which is illustratively a touch screen control panel which can be cleaned with a soft damp cloth. The touch screen control panel 16 is actuated by an operator touching desired portions of the screen of control panel 16.

The touch screen control panel 16 provides increased flexibility for menu driven functions compared to membrane-type switches which are typically used on air supply housings. Function control buttons 28 are located adjacent control panel 16. Control buttons 28 illustratively include a CPR button, a maximum inflate button, an alarm silence button, and a therapy on/off control button. The front and rear case assemblies 22 and 24 are coupled together by suitable fasteners 30 to form the housing 12.

Filter cover 32 is located over an air intake portion of the housing 12. T-shaped elongated feet 32 slide into T-shaped slots 34 formed on opposite sides of front and rear case assemblies 22 and 24. Feet 32 support the housing 12 on the ground. Air supply apparatus 10 further includes an inlet flange 34 and a power cord 36 having any desired length. Magnetic clip assemblies 38 include magnets 40 configured to be coupled to any metal member on the bed frame. The clips 38 retain the power cord 36 in an out of the way position. Power cord 36 includes a plug 42 at one end and a power cord connector 44 at the other end. Connector 44 is configured to be coupled to a connector 46 of air supply apparatus 10.

The front and rear case assemblies 22 and 24 are each formed to include an elongated slot 48 and 50, respectively. Slot 48 is open completely through the first case assembly 22. Slot 50 terminates in an end wall 52 on rear case assembly 24. Slots 48 and 50 cooperate to define an article receiving slot for holding articles such as a user manual 54 which can be inserted into slot 58 in the direction of arrow 56 and stored for convenience. User manual 54 provides instructions for operation of the air supply apparatus 10.

Figure 3:
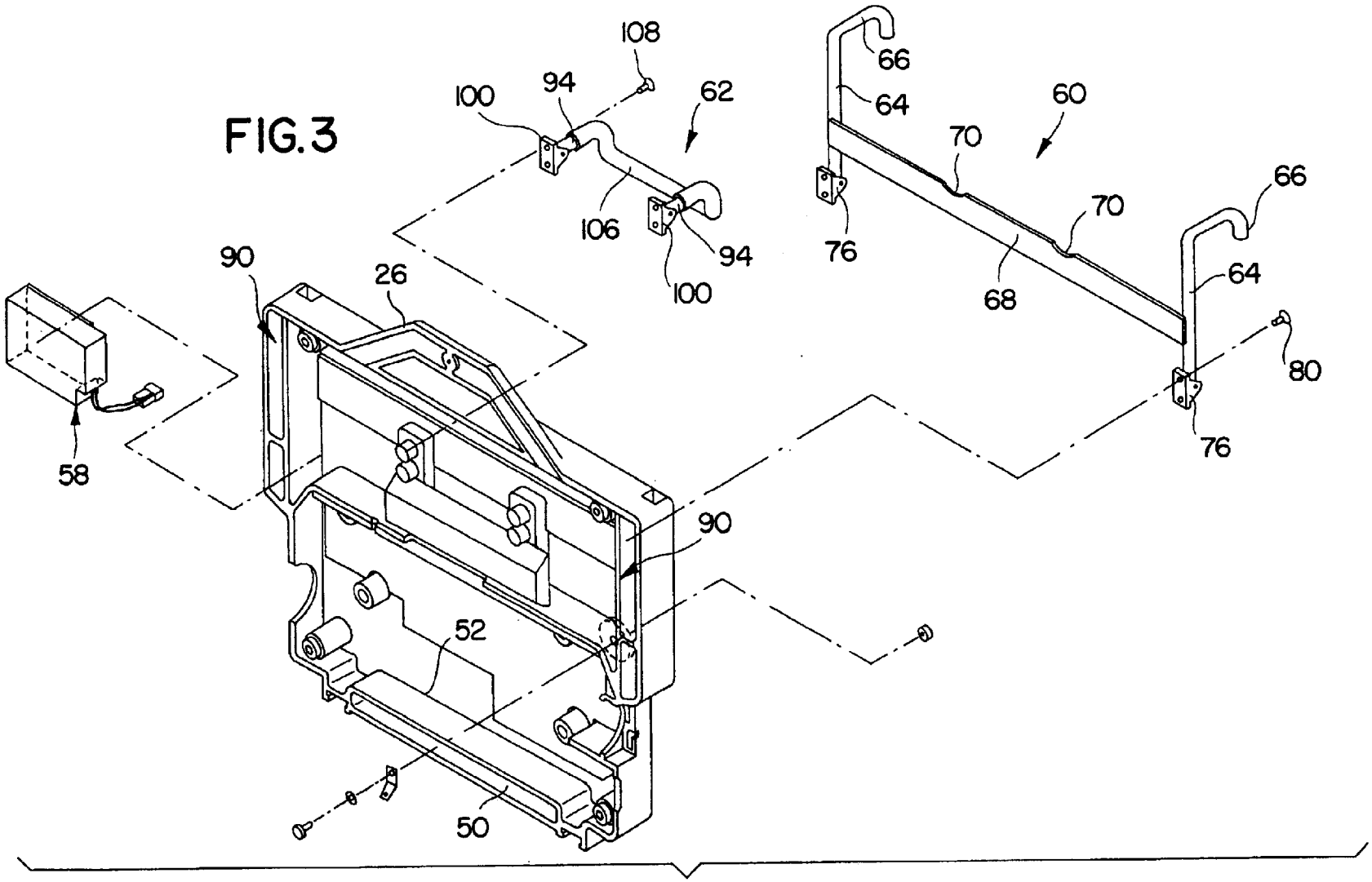
FIG. 3 is an exploded perspective view of a rear case assembly of a housing of the air supply apparatus.

Referring now to FIG. 3, a battery assembly 58 is located within the housing 12. Air supply apparatus 10 includes a first large hanger assembly 60 coupled to housing 12 and a second smaller hanger assembly 62 which is also coupled to housing 12.

Figure 4:
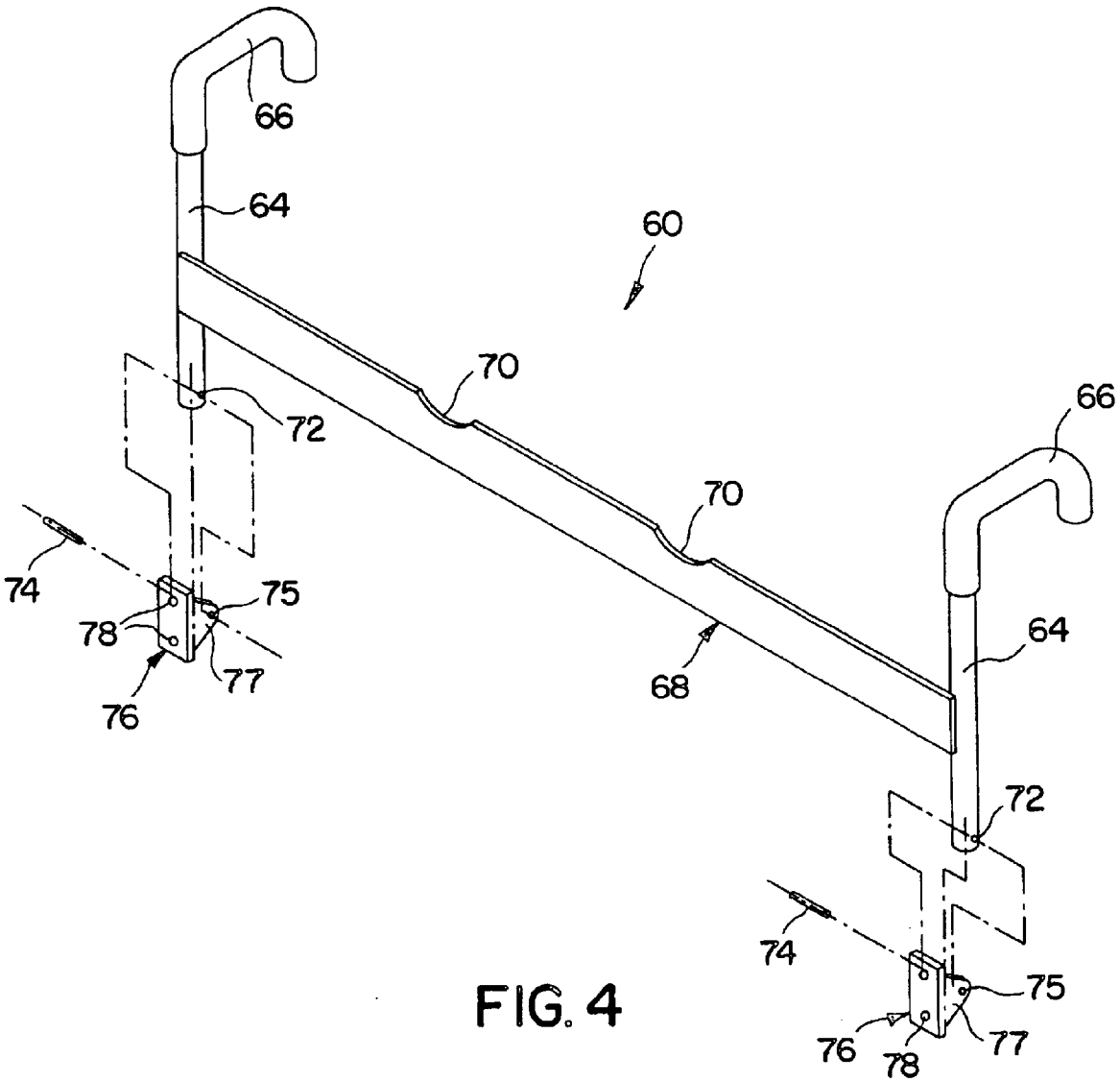
FIG. 4 is an exploded perspective view of a large hanger assembly for mounting the air supply apparatus to a footboard of a bed in a first orientation.

Large hanger assembly 60 is illustrated in FIG. 4. Hanger assembly 60 includes first and second spaced apart mounting arms 64, each having a hook portion 66 for coupling the housing to a footboard 82 of a bed (not shown) as discussed below. Hooks 66 are covered by a protective coating. Large hanger assembly 60 also includes a cross bar 68 coupled to arms 64. Cross bar 68 is formed to include two notched portions 70. Arms 64 are each formed to include an aperture 72 configured to receive a pin 74 to couple the arms 64 to hanger brackets 76. Pins 74 extend through apertures 75 formed in spaced apart flanges 77 of brackets 76. Hanger brackets 76 include a first pair of apertures 78 to permit the hanger assembly 60 to be coupled to the housing 12 with suitable fasteners 80 shown in FIGS. 3 and 6: It is understood that four such fasteners 80 are used to couple the hanger assembly 60 to the housing 12.

Figure 6:
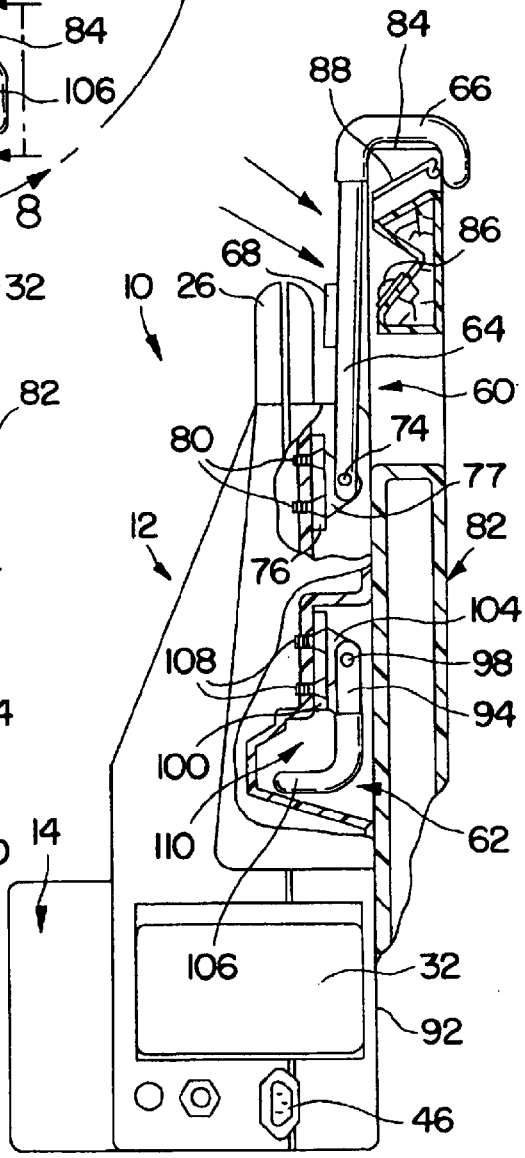
FIG. 6 is a side elevational view, with portions broken away, illustrating the air supply apparatus mounted on a footboard of a bed in the first orientation by the large hanger assembly.

Large hanger assembly 60 is movable from an upwardly extending pivoted position shown in FIGS. 2 and 6 for mounting the housing 12 on a footboard 82 of a bed (not shown). When in the upwardly pivoted position shown in FIGS. 2 and 6, the large hanger assembly 60 is positioned so that hooks 66 extend over and engage a top end edge 84 of footboard 82. Larger hanger assembly 60 is particularly useful in footboards which include control panels 86 built into the footboard 82 for controlling functions of the bed. Footboard 82 may also include a flip panel 88 which provides access to further control functions. Since the arms 64 are spaced apart by a relatively wide distance, the caregiver can still operate the controls 86 or the controls under flip panel 88 while the housing 12 is mounted on the footboard 82. When not in use, the large hanger assembly 60 is pivoted downwardly relative to housing 12 to the storage position shown in FIG. 7. In this storage position, the arms 64 and hooks 66 are stored within recesses 90 formed on opposite sides of the housing 12 so that the entire hanger assembly 60 is located inwardly from a rear wall 92 of housing 12.

Figure 5:
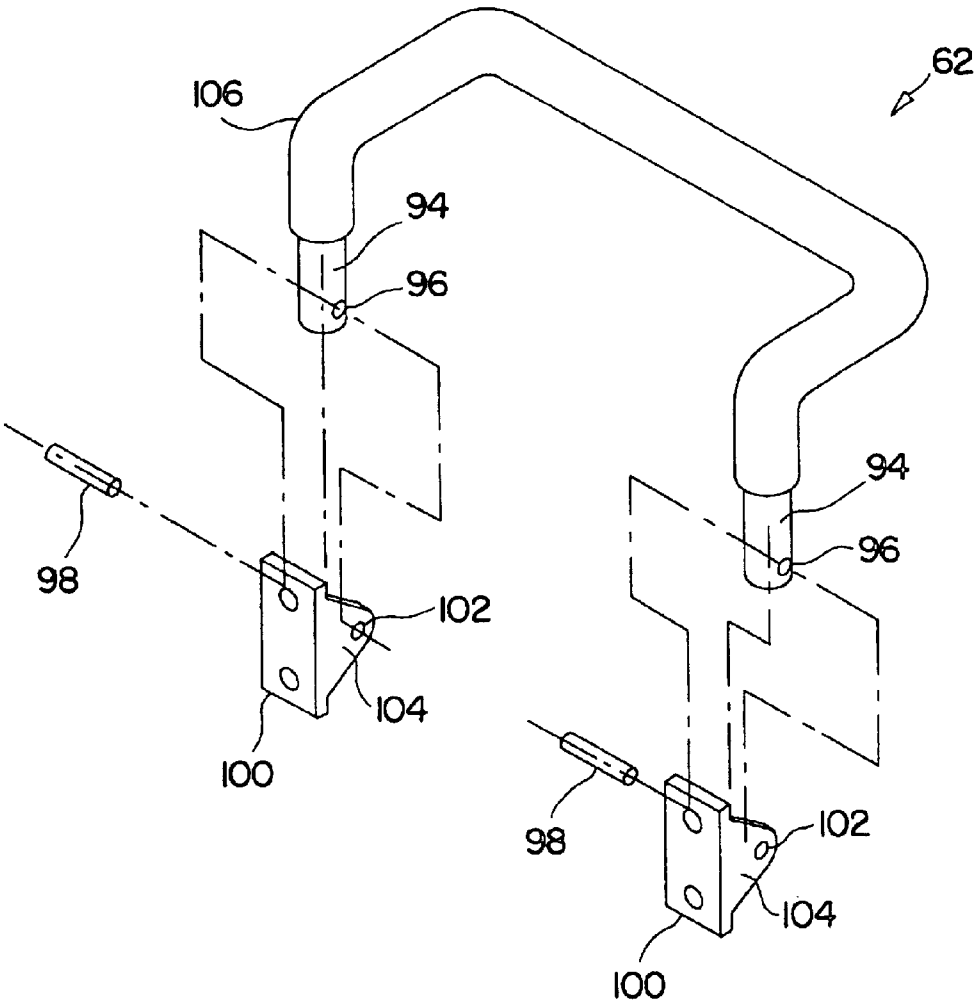
FIG. 5 is an exploded perspective view of a small hanger assembly for mounting the air supply apparatus on the footboard of the bed in a second orientation.
Figure 7:
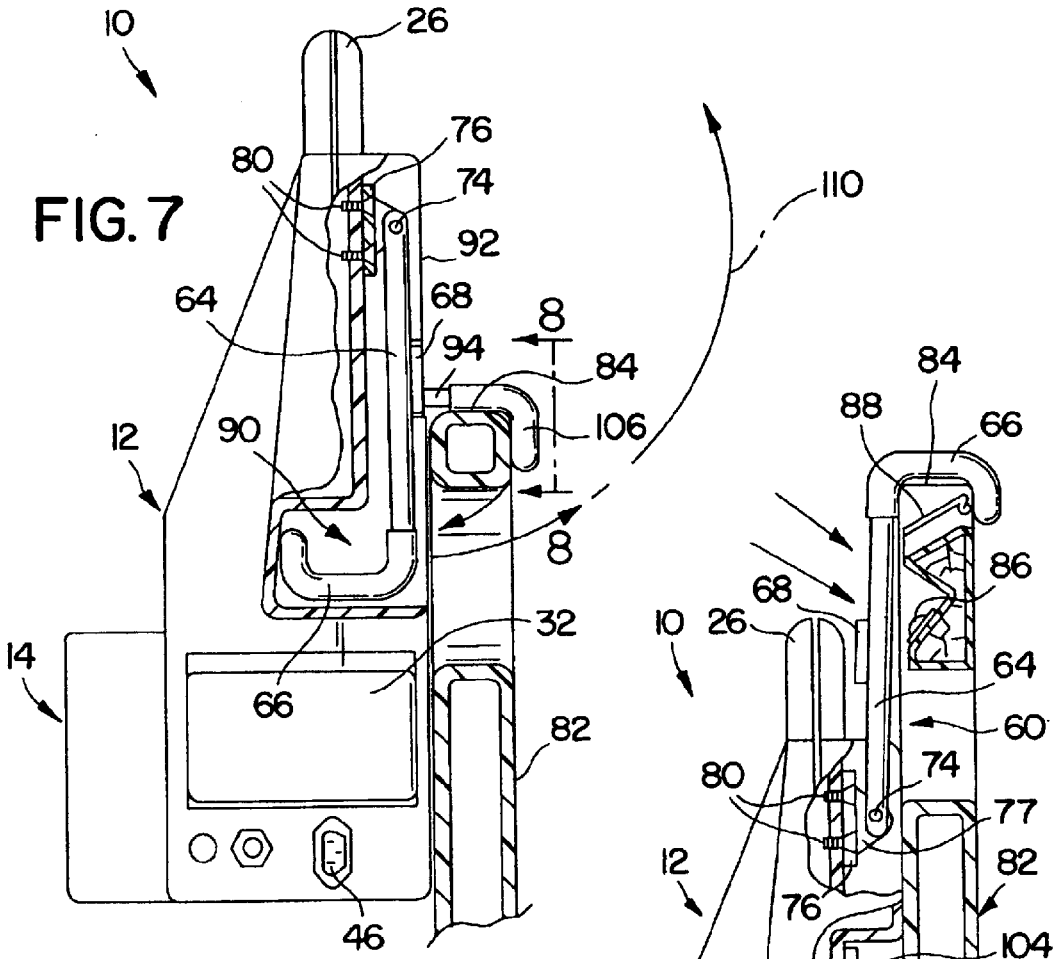
FIG. 7 is a side elevational view, with portions broken away, illustrating the air supply apparatus mounted on the footboard of the bed in the second orientation by the small hanger assembly.

Small hanger assembly 62 is best illustrated in FIG. 5. Hanger assembly 62 includes opposite support arms 94 which are each formed to include an aperture 96 configured to receive a pin 98 for coupling the hanger 62 to mounting brackets 100. Specifically, pins 98 extend through apertures 102 formed in spaced apart flanges 104 of the mounting brackets 100. Hanger assembly 62 also includes a U-shaped section 106 which is illustratively covered by a protective coating to prevent marring of the footboard 82. Mounting brackets 100 are configured to be coupled to housing 12 by fasteners 108 as best shown in FIG. 6.

Figure 8:
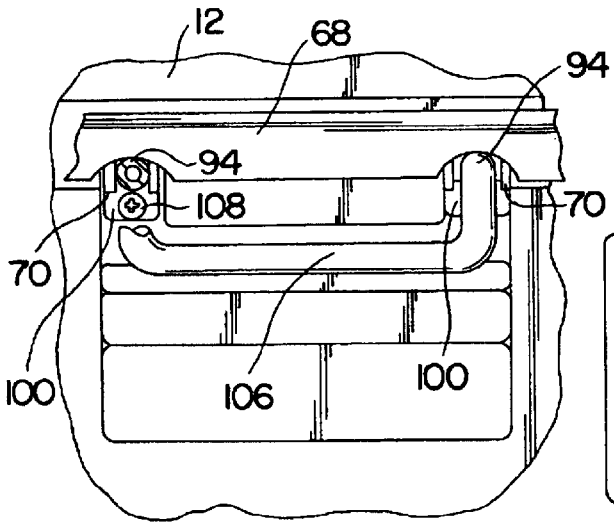
FIG. 8 is a rear elevational view taken along lines 8—8 of FIG. 7, with portions broken, illustrating further details of the small hanger assembly coupled to the footboard.

Small hanger assembly 62 is movable from a downwardly pivoted, storage position shown in FIG. 6 in which the arms 94 and the U-shaped portion 106 are located within a recess 110 of housing 12 so that the entire hanger assembly 62 is located inwardly from the rear wall 92 of housing 12. Hanger 62 is also movable to an upwardly pivoted orientation shown in FIG. 7 to couple the housing 12 to the top end 84 of footboard 82 in a second orientation. In the mounting position shown in FIG. 7, the support arms 94 of hanger 62 engage notched portions 70 formed in crossbar 68 of hanger assembly 60 as best shown in FIG. 8. Therefore, crossbar 68 prevents the small hanger assembly 62 from pivoting further upwardly in the direction of arrow 111 in FIG. 7 to hold the housing 12 on the footboard 82.

Figure 9:
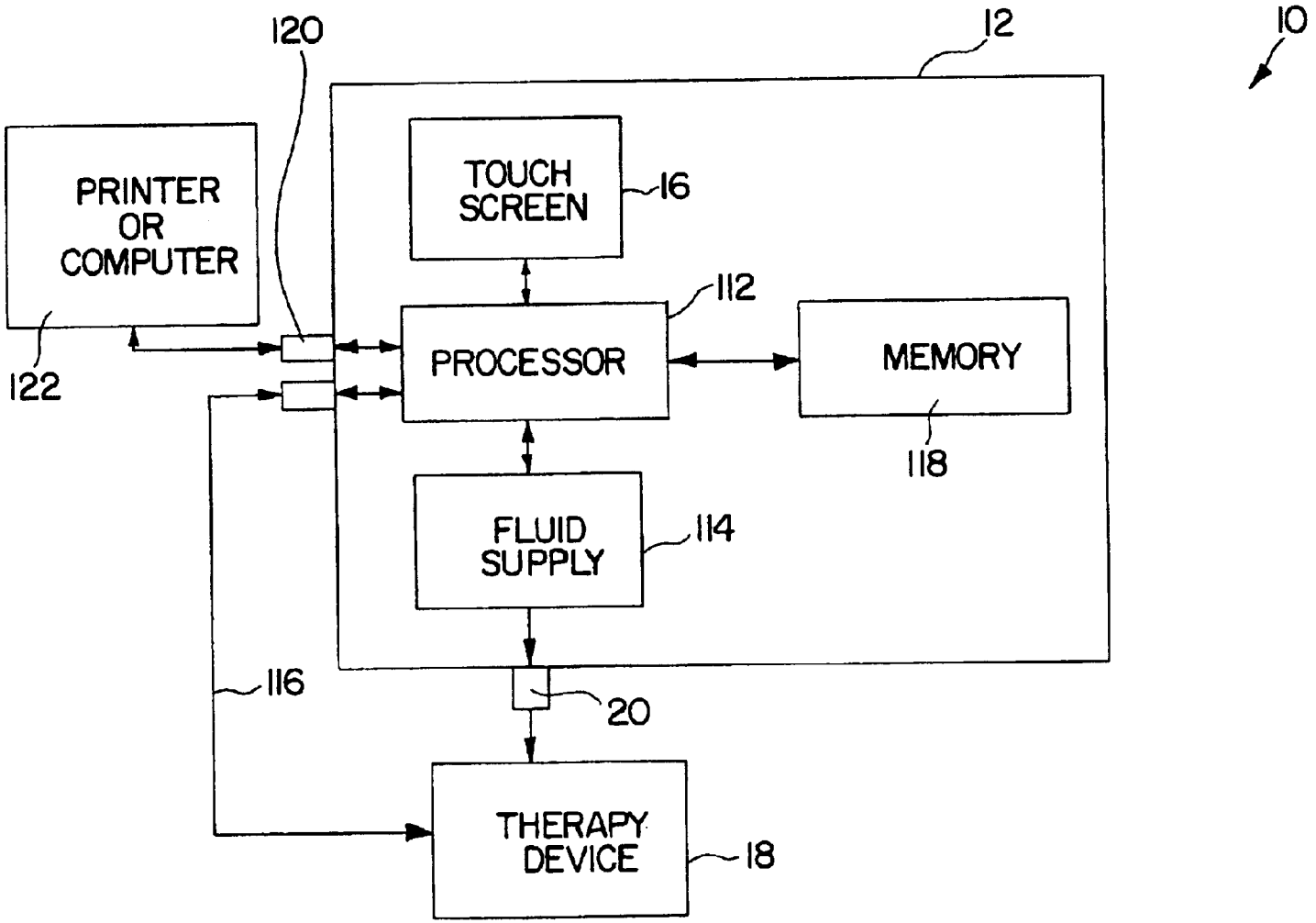
FIG. 9 is a block diagram illustrating further details of the air supply apparatus.

As shown in FIG. 9, the air supply apparatus 10 includes a controller such as a microprocessor 112 coupled to the touch screen control panel 16 and to the fluid supply 114 such as a blower motor, compressor, etc. As discussed above, fluid supply 114 is coupled to the therapy device 18 by tube 20. Processor 112 is also coupled to the therapy device 18 by electrical wire 116 to provide electrical control signals to therapy device 18 and to receive signals from the therapy device 18, if applicable.

A memory 118 is also coupled to the processor 112 within the housing 12. Processor 112 is configured to provide a menu driven display on touch screen 16 to permit a caregiver to provide various therapies to a patient on the therapy device 18. For instance, for the mattress 18, rotation, percussion, vibration, or combinations of these therapies may be provided. In addition, various pressure settings may be provided for air bladders within the mattress 18 to reduce pressure on the patient.

Processor 112 stores each screen press made by an operator on the control panel 16 in a history buffer of memory 118. Therefore, all key presses entered on touch screen control panel 16 are stored within the memory 118. Air supply apparatus, 10 includes a communication port 120 coupled to housing 12 to permit the housing 12 to be coupled directly to a printer or computer 122. Illustratively, port 120 is a serial port coupled to housing 12 and processor 112. Therefore, information related to the therapies provided to the patient or all the inputs entered by the operator can be downloaded to the printer or computer 122. In addition, menus, therapies, or other information can be loaded into the processor 112 from the computer 122. It is understood that the computer 122 could be on site or at a remote location connected via a computer network or telephone line. Therefore, operation of the air supply apparatus 10 can be monitored or controlled from a remote location, if desired Although the invention has been described in detail with reference to a certain illustrated embodiment, variations and modifications exist within the scope and spirit of the present invention as described and defined in the following claims.

What is claimed is:

1. A fluid supply apparatus for controlling a therapy device, the apparatus comprising:

a housing;

a fluid supply located within the housing, the fluid supply being configured to be coupled to the therapy device;

a processor located within the housing, the processor being configured to be electrically coupled to the therapy device;

a touch screen control panel coupled to the housing, the touch screen control panel being electrically coupled to the processor to receive operator inputs to control the therapy device, and a therapy-input-communication port configured to be coupled to a computer to permit the computer to upload information related to the therapy device to the processor.

2. The apparatus of claim 1, further comprising a first hanger coupled to the housing, the first hanger being configured to couple the housing to a footboard of a bed in a first vertical orientation relative to the footboard, and a second hanger coupled to the housing, the second hanger being configured to couple the housing to the footboard in a second vertical orientation relative to the footboard, the second vertical orientation being different from the first vertical orientation.

3. The apparatus of claim 1, further comprising a memory located within the housing, the memory being coupled to the processor to store data related to inputs from the touch screen.

4. The apparatus of claim 3, further comprising a communication port coupled to the housing, the communication port being coupled to the processor and configured to be coupled to a computer to download information from the memory to the computer.

5. The apparatus of claim 3, further comprising a communication port coupled to the housing, the communication port being coupled to the processor and configured to be coupled to a printer to print information stored in the memory.

6. The apparatus of claim 1, wherein the computer transmits to the processor a menu to be displayed on the touch screen control panel for controlling the therapy device.

7. A fluid supply apparatus for controlling a therapy device, the apparatus comprising:

a housing;

a fluid supply located within the housing, the fluid supply being configured to be coupled to the therapy device;

a processor located within the housing, the processor being configured to be electrically coupled to the therapy device;

a touch screen control panel coupled to the housing and electrically coupled to the processor, the touch Screen control panel including a screen to display information, the screen having a plurality of portions that receive inputs from an operator to control the therapy device, a first hanger coupled to the housing, the first hanger being configured to couple the housing to a footboard in a first orientation such that a center of gravity of the housing is at a first vertical position, and a second hanger coupled to the housing, the second hanger being configured to couple the housing to the footboard in a second orientation such that the center of gravity of the housing is at second vertical position.

8. The apparatus of claim 7, wherein the first hanger is pivotally coupled to the housing and the second hanger is pivotally coupled to the housing.

9. The apparatus of claim 7, wherein the first anger is moveable relative to the housing.

10. The apparatus of claim 7, wherein the first hanger is movable between a hanging position and a storage position and the second hanger is movable between a hanging position and a storage position.

11. The apparatus of claim 10, wherein the second hanger is in the storage position when the housing is coupled to the footboard in the first orientation.

12. A fluid supply apparatus for a therapy device, the apparatus comprising:

a housing that defines a storage receptacle configured to substantially enclose an article, the storage receptacle defining an opening such that the storage receptacle is accessible from the exterior of the housing;

a fluid supply located within the housing, the fluid supply being configured to be coupled to the therapy device; and a controller located within the housing, the controller being coupled to the fluid supply.

13. The apparatus of claim 12, further comprising a user manual configured to be inserted into the storage receptacle.

14. The apparatus of claim 12, wherein the slot is formed adjacent a bottom end of the housing.

15. The apparatus of claim 14, wherein the slot is formed in the housing below the fluid supply.

16. The apparatus of claim 12, further comprising a first hanger coupled to the housing, the first hanger being configured to couple the housing to the footboard in a first orientation, and a second hanger coupled to the housing, the second hanger being configured to couple the housing to the footboard in a second orientation.

17. The apparatus of claim 12 wherein the storage receptacle includes an elongated slot.

18. A fluid supply apparatus for a therapy device, the apparatus comprising:

a housing formed to include an elongated slot configured to define a storage receptacle, the housing including a front case and a rear case configured to be coupled together to define the housing, a first portion of the slot being formed by the front case and a second portion of the slot being formed by the rear case;

a fluid supply located within the housing, the fluid supply being configured to be coupled to the therapy device; and a controller located within the housing, the controller being coupled to the fluid supply.

19. A fluid supply apparatus for controlling a therapy device, the apparatus comprising:

a housing;

a fluid supply located within the housing, the fluid supply being configured to be coupled to the therapy device;

a processor located within the housing, the processor being configured to be electrically coupled to the therapy device;

a memory located within the housing, the memory being coupled to the processor to store data;

a control panel coupled to the housing, the control panel being electrically coupled to the processor to receive operator inputs to control the therapy device; and a communication port coupled to the housing, the communication port being coupled to the processor and configured to be coupled to a computer to download information from the memory to the computer and to upload information related to the therapy device to the processor.

20. The apparatus of claim 19, wherein the communication port is also configured to be coupled to a printer to print information stored in the memory.

21. The apparatus of claim 19, wherein the control panel is a touch screen control panel.

22. A fluid supply apparatus for controlling a therapy device, the apparatus comprising:

a housing;

a fluid supply located within the housing, the fluid supply being configured to be coupled to the therapy device;

a processor located within the housing, the processor being configured to be electrically coupled to the therapy device;

a memory located within the housing, the memory being coupled to the processor to store data;

a control panel coupled to the housing, the control panel being electrically coupled to the processor to receive operator inputs to control the therapy device;

a communication port coupled to the housing, the communication port being coupled to the processor and configured to be coupled to a computer to download information from the memory to the computer;

a first hanger coupled to the housing, the first hanger being configured to couple the housing to the footboard in a first orientation, and a second hanger coupled to the housing, the second hanger being configured to couple the housing to the footboard in a second orientation, use of the second hanger being mutually exclusive with use of the first hanger.

23. The apparatus of claim 22, wherein the first hanger places the housing at a first height and the second hanger places the housing at a second height.

24. The apparatus of claim 22, wherein the first hanger is movable between a hanging position engaging the footboard and a storage position disengaged from the footboard and the second hanger is movable between a hanging position engaging the footboard and a storage position disengaged from the footboard.

25. The apparatus of claim 24, wherein the second hanger is in the storage position when the housing is coupled to the footboard in the first orientation.

26. A fluid supply apparatus for controlling a therapy device, the apparatus comprising:

a housing;

a fluid supply located within the housing, the fluid supply being configured to be coupled to the therapy device;

a processor located within the housing, the processor being configured to be electrically coupled to the therapy device;

a touch screen control panel coupled to the housing and electrically coupled to the processor, the touch screen control panel including a screen to display information, the screen having a plurality of portions that receive inputs from an operator to control the therapy device, and a therapy-input-communication port configured to be coupled to a computer to permit the computer to upload information related to the therapy device to the processor.

27. The apparatus of claim 26, further comprising a memory located within the housing, the memory being coupled to the processor to store data related to inputs from the touch screen.

28. The apparatus of claim 27, further comprising a communication port coupled to the housing, the communication port being coupled to the processor and configured to be coupled to a computer to download information from the memory to the computer.

29. The apparatus of claim 27, further comprising a communication port coupled to the housing, the communication port being coupled to the processor and configured to be coupled to a printer to print information stored in the memory.

30. The apparatus of claim 26, wherein the computer transmits a menu for controlling the therapy device to the processor to be displayed on the touch screen control panel.

31. A fluid supply apparatus for a therapy device, the apparatus comprising:

a housing including means for defining a storage receptacle for receiving an article;

a fluid supply located within the housing, the fluid supply being configured to be coupled to the therapy device; and a controller located within the housing, the controller being coupled to the fluid supply.

32. A fluid supply apparatus for a therapy device, the apparatus comprising:

a housing including a slot forming a storage receptacle, the slot having an opening such that the storage receptacle is accessible from the exterior of the housing and the slot having a depth that is greater than a dimension of the opening;

a fluid supply located within the housing, the fluid supply being configured to be coupled to the therapy device; and a controller located within the housing, the controller being coupled to the fluid supply.

33. A fluid supply apparatus for a therapy device, the apparatus comprising:

a housing formed to include an elongated slot configured to define a storage receptacle;

a fluid supply located within the housing, the fluid supply being configured to be coupled to the therapy device;

a first hanger coupled to the housing, the first hanger being configured to couple the housing to a footboard of a bed in a first vertical orientation relative to the footboard; and a second hanger coupled to the housing, the second hanger being configured to couple the housing to the footboard in a second vertical orientation relative to the footboard, the second vertical orientation being different from the first vertical orientation.

* * * * *